US005401545A

United States Patent [19]

Hyde

[11] Patent Number: 5,401,545

[45] Date of Patent: Mar. 28, 1995

[54] ARTIFICIAL CHRISTMAS TREE

[76] Inventor: Debra A. Hyde, 231 Spruce St., Elyria, Ohio 44035

[21] Appl. No.: 221,783

[22] Filed: Apr. 1, 1994

[51] Int. Cl.[6] ..... A47G 33/06

[52] U.S. Cl. ..... 428/18; 211/196; 211/205; 428/20

[58] Field of Search ..... 428/18, 20; 211/196, 211/205

[56] References Cited

U.S. PATENT DOCUMENTS

| | | | |
|---|---|---|---|
| 3,003,623 | 10/1961 | Paul et al. | 428/18 X |
| 3,011,280 | 12/1961 | Keidd | 428/18 X |
| 3,499,818 | 3/1970 | Kent | 428/18 |
| 3,594,260 | 7/1971 | Dieffenbach | 428/20 |
| 3,857,748 | 12/1974 | Thomann | 428/20 X |
| 3,970,834 | 7/1976 | Smith | 428/20 X |
| 4,109,036 | 8/1978 | Lloyd et al. | 428/8 |
| 4,612,218 | 9/1986 | Enterline | 428/8 |

*Primary Examiner*—Henry F. Epstein
*Attorney, Agent, or Firm*—Rhodes & Ascolillo

[57] ABSTRACT

An artificial Christmas tree has a trunk member. The trunk member has an elongated rod that has at least two threadingly disconnectable sections. There are a plurality of elongated limb storage chambers in the elongated rod. A stabilizational plate is attached to one end of the elongated rod to horizontally stabilize the elongated rod. A vertical structure support member is attached to another end of the elongated rod to vertically stabilize the elongated rod. There are a plurality of flexible limb members stored within the elongated limb chambers that slidingly traverse within and adjustably extend from the elongated storage chambers.

4 Claims, 3 Drawing Sheets

ARTIFICIAL CHRISTMAS TREE

BACKGROUND OF THE INVENTION

1. Field of the Invention

This invention relates to an artificial christmas tree having retractable limbs so that the tree may be configured branch-wise to fit in various close quarter positions in a dwelling such as a corner or fiat against a wall.

2. Description of the Related Art

U.S. Pat. No. 3,594,260 to P. Dieffenbach on Jul. 20, 1971 for an Artificial Shrubbery and Method of Manufacturing the Same describes flexible artificial limbs which are inserted into stiff wound wire support members. The wire support members may then be attached to tubular members.

U.S. Pat. No. 3,857,748 to C. S. Thomann on Dec. 31, 1974 for a Christmas Tree Assembly shows an artificial tree to be hung on a vertical structure such as a door. The assembly has a basically triangular back plate onto which a tubular branch support member is attached. Artificial branches have an end that is snugly forced into insertion holes in the tubular branch support at selected intervals until a portion of a tree is simulated.

U.S. Pat. No. 4,109,036 to G. Lloyd, et al., on Aug. 22, 1978 for an Artificial Christmas Tree is described. A plurality of branches to simulate artificial foliage are placed into holes in artificial trunk members. The trunk members are screwed into a vertical structure. This allows the user to place a simulated portion of a tree against a wall.

U.S. Pat. No. 4,612,218 to B. J. Enterline on Sep. 16, 1986 for Artificial Christmas Trees shows a very narrow dimension tree simulation wherein a plurality of limb fronds of varying lengths are selectively placed into apertures in a basically triangular mounting board which is attached to a vertical Surface.

SUMMARY OF THE INVENTION

The present invention is an artificial Christmas tree with a special design that enables it to be placed easily into a corner or fiat against a wall. Many people face the dilemma of desiring a large well rounded tree yet having a problem in placing it in a room too small to handle the tree without cutting or crushing the limbs. The present invention allows the user to extend the limbs out of their storage chambers to a required length. This allows the user to place the tree in a corner or against a wall or any desired distance from a corner or wall without damaging the limbs. The horizontal and vertical stabilizing members assist the user in stabilizing the tree if a majority of decorations on one side of the tree cause the tree to be unstable.

A first embodiment of an artificial Christmas tree is shown that has a trunk member. The trunk member has an elongated rod and a plurality of elongated limb storage chambers in the elongated rod. There is a vertical structure support member attached to the elongated rod to vertically stabilize the elongated rod. A plurality of flexible limb members are stored and slidingly traverse within and adjustably extending from the elongated storage chambers. The elongated rod may also have at least two disconnectable sections for ease of storage and assembly. A stabilizational plate can be attached to the elongated rod to horizontally stabilize the elongated rod.

It is an object of this invention to provide an artificial Christmas tree that has retractable limbs that may be extended or retracted as required in order that the tree may be placed in a corner, against a wall or placed apart from any restriction to limb extension for full plumage of the limbs around the trunk.

It is another object of this invention to allow the limbs to be stored within and extended from or retracted within storage chambers within the trunk.

DESCRIPTION OF THE PREFERRED EMBODIMENTS

Figure 1:
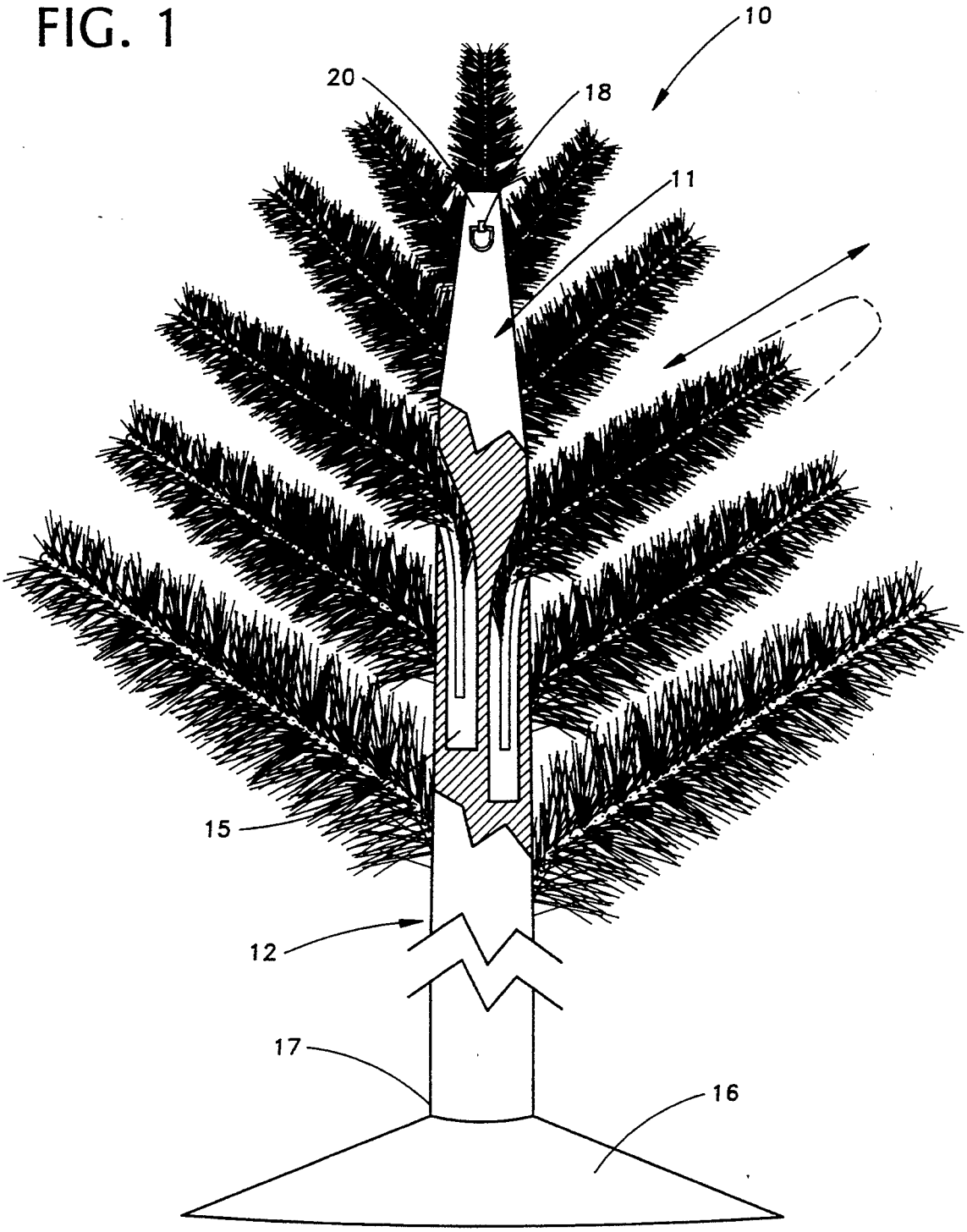
FIG. 1 is a foreshortened, partial cutaway, rear, elevational view of an Artificial Christmas Tree showing how the artificial limbs slide in and out of their storage chambers for storage and length adjustment.
Figure 2:
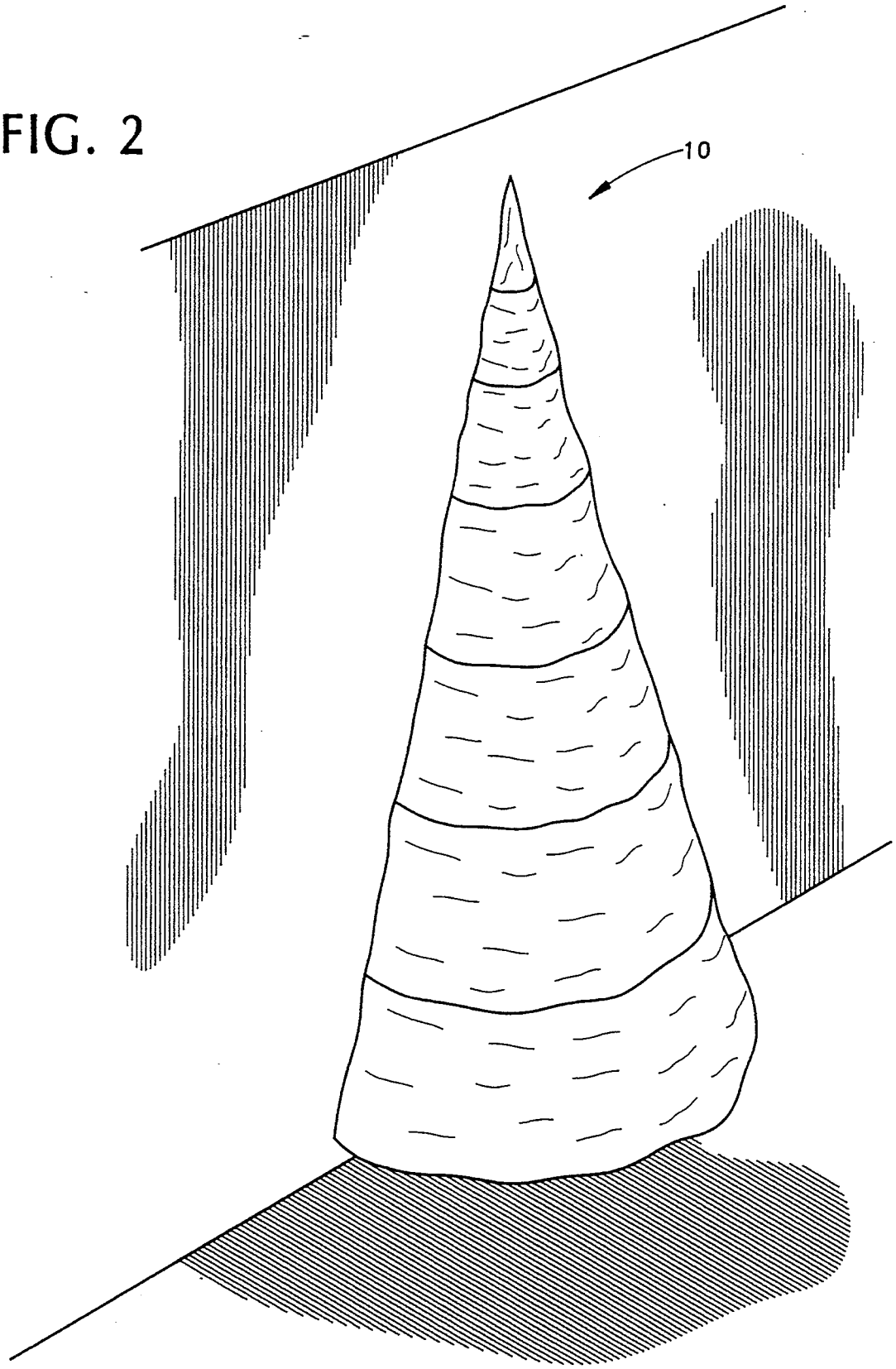
FIG. 2 is a perspective environmental view of the tree decorated and shown in use, supported on a floor by a horizontal stabilization member and held in a vertical position by a vertical stabilization member.
Figure 3:
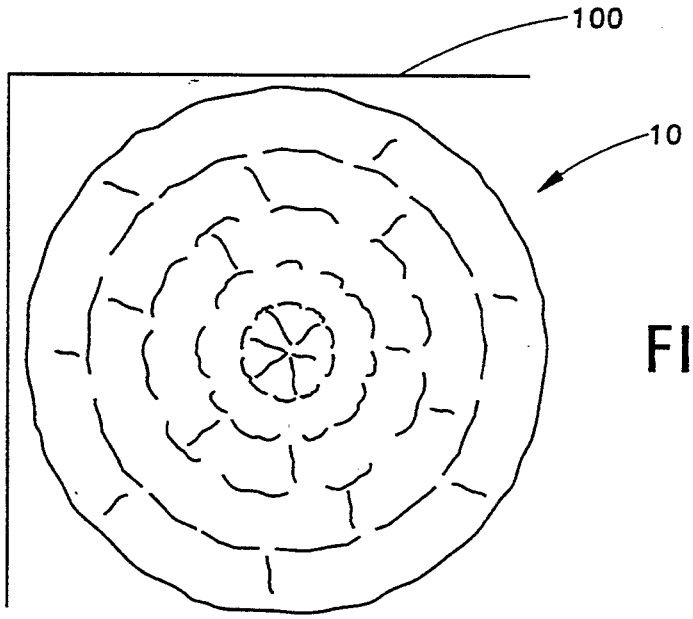
FIG. 3 is a top plan view of the tree in a position enabling the user to place the limbs completely around the trunk member.
Figure 4:
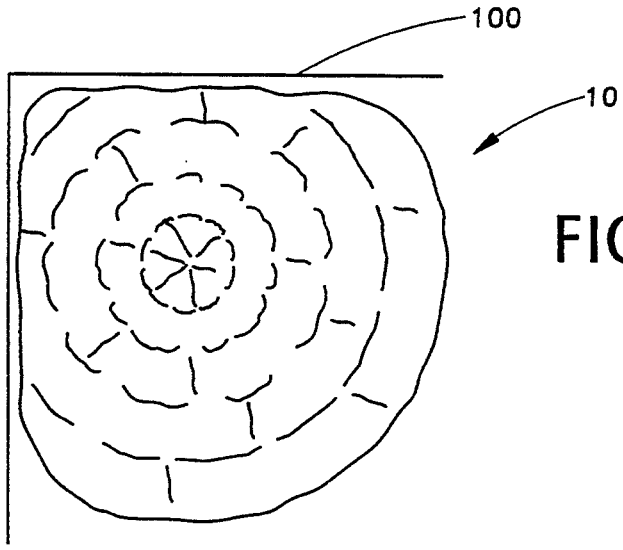
FIG. 4 is a top plan view of the tree in a corner position and having the limbs toward the corner retracted.
Figure 6:
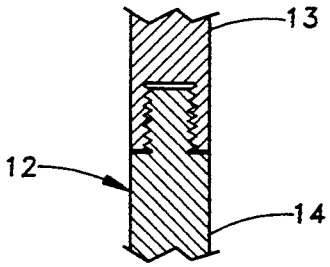
FIG. 6 is a partial, cross-sectional, front elevational view of the two threadingly disconnectable sections of the elongated rod of the trunk member.
Figure 5:
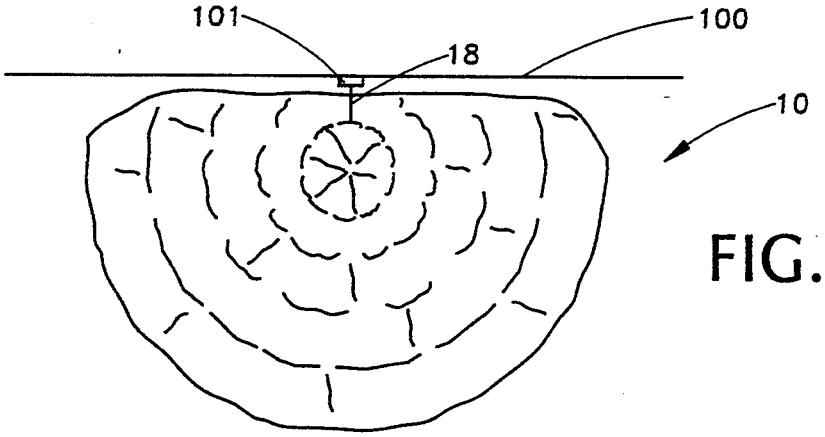
FIG. 5 is a top plan view of the tree on a fiat vertical structure and having the limbs toward the vertical structure retracted.

Referring to FIGS. 1 through 6, an artificial Christmas tree 10 is shown and described that has a trunk member 11. The trunk member 11 has an elongated rod 12 that has at least two threadingly disconnectable sections 13 and 14. There are a plurality of elongated limb storage chambers 15 in the elongated rod 12. A stabilizational plate 16 is attached (by suitable fasteners such as screws or possibly press-fitted) to one end 17 of the elongated rod 12 to horizontally stabilize the elongated rod 12. A vertical structure support member 18 is attached (by suitable fasteners such as screws, staples or glue) to another end 20 of the elongated rod 12 to vertically stabilize the elongated rod 12 if required. The vertical structure support member 18 may be a fiber or metal loop that can be mated with a hook 101 on a nearby vertical surface 100.There are a plurality of flexible limb members stored within the elongated limb chambers that slidingly traverse within and adjustably extend from the elongated storage chambers. The artificial limb members may be a length of twisted wire holding artificial needles in place or flexible plastic wands having artificial needles pressed therein or other suitable means to simulate artificial Christmas tree branches. The elongated chambers 15 may either be molded as cavities when the elongated rod 12 is formed or may be drilled into an already formed rod 12.

In operation, the sections of the elongated rod are assembled, the limbs are pulled from their respective storage chambers to a desired length. The tree is then stabilized by attaching the vertical support member to a nearby vertical structure such as a wall and the stabilizational plate 16 is placed on the end of the elongated rod and positioned on the floor so as to further stabilize the tree. Ornaments may then be added and the vertical support member and the stabilization plate adjusted as needed to compensate for the additional weight.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. An artificial Christmas tree comprising:

(a) a trunk member comprising:

an elongated rod;

a plurality of elongated limb storage chambers in the elongated rod; and a vertical structure support member attached to the rod member to vertically stabilize the elongated rod; and (b) a plurality of flexible limb members stored within and slidingly traversing within and adjustably extending from the elongated storage chambers.

2. An artificial Christmas tree as described in claim 1 wherein the elongated rod further comprises at least two disconnectable sections for ease of storage and assembly.

3. An artificial Christmas tree as described in claim 1 wherein the elongated rod further comprises a stabilizational plate attached to the elongated rod to horizontally stabilize the elongated rod.

4. An artificial Christmas tree comprising:

(a) a trunk member comprising:

an elongated rod having at least two threadingly disconnectable sections;

a plurality of elongated limb storage chambers in the elongated rod;

a stabilizational plate attached to one end of the elongated rod to horizontally stabilize the elongated rod; and a vertical structure support member attached to another end of the elongated rod to vertically stabilize the elongated rod; and (b) a plurality of flexible limb members stored within and slidingly traversing within and adjustably extending from the elongated storage chambers.

* * * * *